US005692644A

United States Patent [19]

Gueret

[11] Patent Number: 5,692,644

[45] Date of Patent: Dec. 2, 1997

[54] CONTAINER FOR STORING AT LEAST TWO PRODUCTS, MIXING THESE PRODUCTS, AND DISPENSING THE MIXTURE THUS OBTAINED

[75] Inventor: Jean-Louis Gueret, Paris, France

[73] Assignee: L'Oreal, Paris, France

[21] Appl. No.: 506,699

[22] Filed: Jul. 25, 1995

[30] Foreign Application Priority Data

Jul. 25, 1994 [FR] France ..... 94 09160

[51] Int. Cl.[6] ..... B65D 81/32

[52] U.S. Cl. ..... 222/80; 222/129; 206/222; 215/DIG. 8

[58] Field of Search ..... 222/129, 80; 215/DIG. 8; 206/219, 22; 604/87

[56] References Cited

U.S. PATENT DOCUMENTS

| | | | |
|---|---|---|---|
| 2,773,591 | 12/1956 | Jensen | 215/DIG. 8 X |
| 2,786,769 | 3/1957 | Greenspan | 215/DIG. 8 X |
| 3,070,094 | 12/1962 | Sarnoff et al. | 215/DIG. 8 X |
| 3,537,605 | 11/1970 | Solowey | 206/222 |
| 3,802,604 | 4/1974 | Morane et al. | 222/129 |
| 4,103,772 | 8/1978 | Wiegner | 206/222 |
| 4,950,237 | 8/1990 | Henault et al. | 222/129 X |
| 4,962,853 | 10/1990 | Hildebrandt | 215/DIG. 8 X |
| 5,172,807 | 12/1992 | Dragan et al. | 206/222 X |

FOREIGN PATENT DOCUMENTS

| | | | |
|---|---|---|---|
| 101594 | 2/1984 | European Pat. Off. . | |
| 2724519 | 3/1978 | Germany | 206/222 |
| 28 09 646 | 9/1979 | Germany . | |
| 3635574 | 4/1988 | Germany . | |
| 92 09 105.9 | 12/1993 | Germany . | |
| 2 021 513 | 12/1979 | United Kingdom . | |

*Primary Examiner*—Kevin P. Shaver
*Attorney, Agent, or Firm*—Oliff & Berridge

[57] ABSTRACT

A container for separately storing at least two products, mixing those products and for dispensing the mixture includes a first reservoir for liquid and a second cylindrical reservoir for powder. The second reservoir has a mouth that is contiguous with the first reservoir. A movable wall blocks the mouth of the second reservoir. A cylindrical part is movable from a position outside the second reservoir through the second reservoir and into the first reservoir after penetrating the mouth of the first reservoir by displacing the movable wall to thereby displace the powder into the first reservoir.

19 Claims, 7 Drawing Sheets

CONTAINER FOR STORING AT LEAST TWO PRODUCTS, MIXING THESE PRODUCTS, AND DISPENSING THE MIXTURE THUS OBTAINED

BACKGROUND

The present invention relates to a container for storing at least two products, mixing these products, and dispensing the mixture thus obtained.

Such a container is disclosed, for example, in FR-A-2.129.079 (which corresponds to U.S. Pat. No. 3,802,604). This container comprises a first reservoir for containing a liquid product and provided with a dispensing orifice, and a second cylindrical reservoir for containing a powdered product and having a bottom and a mouth that is fixed relative to and contiguous with the first reservoir. A movable wall blocks the mouth of the second reservoir. A movable cylindrical part having an outside cross section similar to the inside cross section of the second reservoir is movable between a first position located outside the first reservoir and a second position penetrating into the first reservoir. Movement of the cylindrical part to the second position displaces the movable wall and thus permits fluid communication between the two reservoirs.

The above described container has the advantage of being able to contain separately a first product, e.g., a liquid, in the first reservoir and a second product, e.g., a powder, in the second reservoir. Packaged in this way, the two products can be stored for a long period of time, which might not otherwise be possible if they were mixed when introduced into the container.

The above-described container, however, has a number of drawbacks. In particular, requires a large number of parts, thus rendering it difficult and expensive to manufacture. In addition, its arrangement is such that when the two products are mixed, it is necessary to position the container such that the second reservoir is above the first reservoir to prevent mixing inside the second reservoir. This is because the volume of the second reservoir is not propitious for good homogenization of the mixture. Moreover, when the second reservoir contains a powder, introduction of a liquid from the first reservoir into the second reservoir causes the formation of lumps of powder that can agglutinate in the second reservoir.

SUMMARY OF THE INVENTION

A goal of the present invention is to provide a container that overcomes the drawbacks referred to above.

The present invention relates to a container for storing at least two products, mixing of these products, and dispensing of the mixture thus obtained. The container comprises a first reservoir able to contain a liquid product and provided with a dispensing orifice, and a second cylindrical reservoir able to contain a powdered product and having a bottom and a mouth that is fixed relative to and is contiguous with the first reservoir. A movable wall blocks the mouth of the second reservoir, and a movable cylindrical part, which has an outside cross section similar to the inside cross section of the second reservoir, is movable between a first position located outside the first reservoir and a second position located in the first reservoir for displacing the movable wall. The container includes a movable part that has a transverse partition which forms the bottom of the second reservoir. The transverse partion is located, when the movable part is in the first position, at a distance from the mouth of the second reservoir that is substantially the same as or less than the travel of the movable part.

It will be understood that when the movable part moves into its second position, the volume of the second reservoir decreases to the point of becoming zero so that the product contained in the second reservoir is driven into the first reservoir and the two products contained in the respective reservoirs become appropriately mixed regardless of the orientation of the container.

According to the invention, "cylindrical" is understood to be a shape generated by moving a straight line in parallel to a given direction along a given closed contour. The contour can be circular, oval, square, rectangular, etc.

BRIEF DESCRIPTION OF THE DRAWINGS

For a better understanding of the invention, embodiments of the present invention provided as nonlimiting examples will now be described with reference to the figures, wherein.

DETAILED DESCRIPTION OF PREFERRED EMBODIMENT

In a first embodiment of the invention, the transverse partition of the movable part includes a planar surface that is surrounded by an edge having an upper end located in a plane inclined relative to a plane perpendicular to the direction of movement of the movable part. In this embodiment, the overall beveled shape of the edge facilitates elimination of the movable wall.

In a second embodiment of the invention, the transverse partition of the movable part is perpendicular to the direction in which the latter moves, but preferably includes a protrusion that serves as a perforator of the movable wall.

In a third embodiment, the second reservoir has a circular inside cross section and the transverse partition is designed to receive a ball having substantially the same diameter as the movable part. Thus, the product of the second reservoir is initially contained between the movable wall and the ball. In this manner, passage of the movable part into the second position ejects the ball, and hence, complete evacuation of the product in the first reservoir is obtained. The ball thus released can then function as a mixer.

According to a preferred embodiment of the invention, dispensing of the mixture is ensured by a pump mounted on the container.

In a first variant, the pump is accommodated near the dispensing orifice of the first reservoir.

In a second variant, a return element is provided to bring the movable part back to the first position. In this variant, after the two products are mixed by eliminating the movable wall, the movable part is able to create an overpressure in the first reservoir. The overpressure causes ejection of a predetermined dose of mixture via the dispensing orifice of the container. The return element may, for example, consist of a helical spring or a bellows provided in the side wall of a part supporting the movable part.

According to the invention, it is also possible to provide a container having walls that are elastically deformable by external pressure so that ejection of the product contained in the first reservoir can easily be achieved by slightly deforming the side walls of the container. With such an arrangement, the use of a pump is unnecessary.

Figure 1:
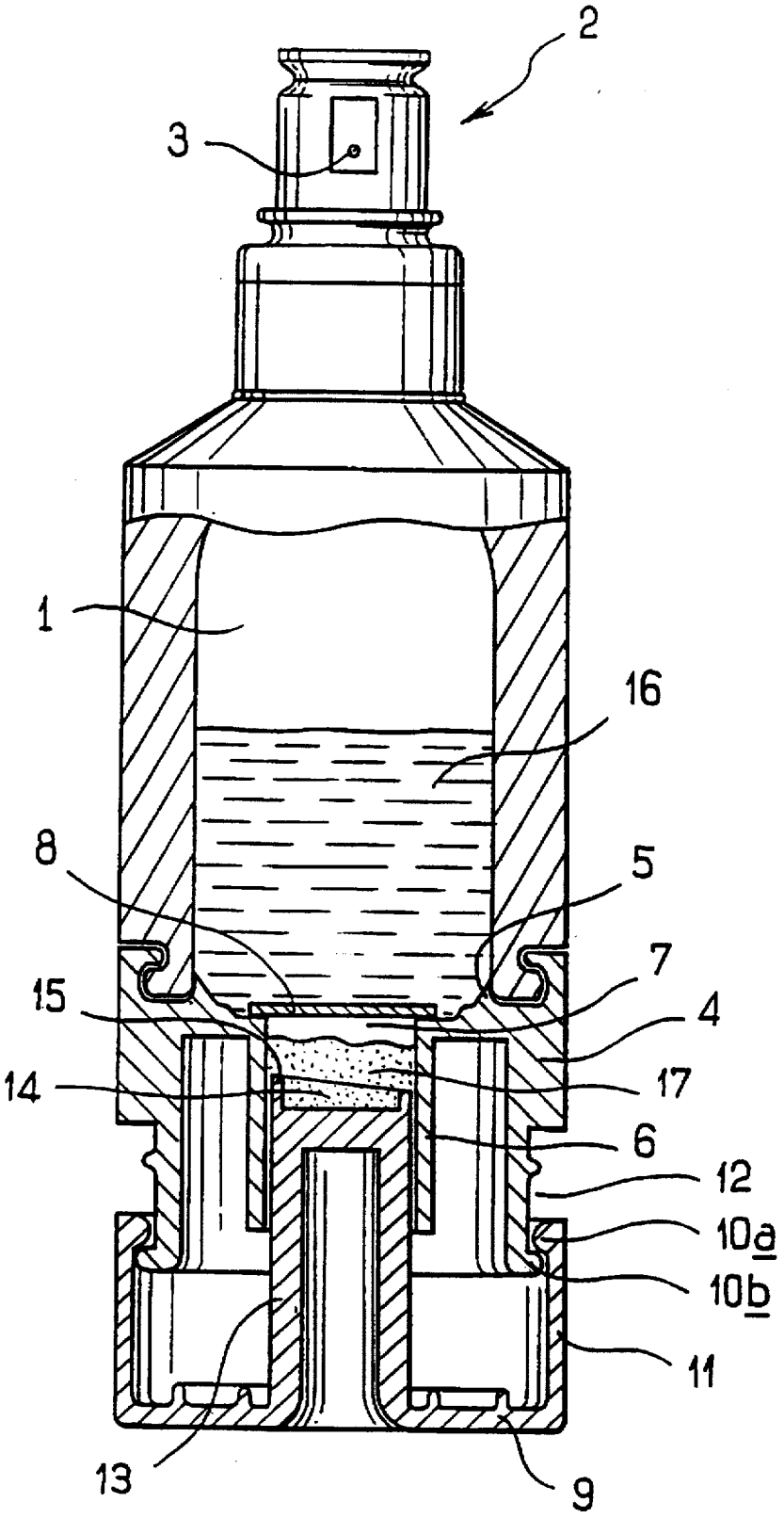
FIG. 1 is a view in elevation and in partial section of a container according to a first embodiment of the invention.

The container of FIG. 1 comprises a bottle of a generally cylindrical shape having a first reservoir 1 provided with a pusher mechanism 2 at its upper portion. The pusher mechanism 2 actuates a pump (not shown), to dispense a dose of a product contained in reservoir 1 through a dispensing orifice 3. The bottle may be made of an injection-molded plastic, such as polypropylene for example, or other suitable material.

A base 4 snaps onto the lower end of the bottle through cooperating connecting members integrally formed on the base 4 and the wall of reservoir 1. The base 4 may be made of, for example, polypropylene. Base 4 has sealing lips 5 which rest against the inside wall of reservoir 1 and seal the latter. A cylindrical shaft 6 is formed in a central portion of base 4 and forms side walls of a second reservoir 7.

A seal 8 separates the two reservoirs 1 and 7 by blocking the mouth of the second reservoir 7. The latter is fixed with respect to first reservoir 1. The seal 8 is rendered fluid-tight by, for example, being heat-welded to base 4.

A pusher 9 is held to the lower part of base 4 by an internal annular swelling 10*a* of the side wall 11 of the pusher. A recess 12 is formed in the base 4, and a rib 10*b* engages the swelling 10*a* to maintain the pusher 9 on the base 4.

Pusher 9 includes, in a center portion thereof, a piston 13 having an external cross-section substantially equal to the internal cross-section of shaft 6, which movably receives the piston 13. Piston 13 has a plane wall 14 surrounded by an edge 15 having an upper end located in a plane that is inclined relative to a plane perpendicular to the direction of movement of piston 13.

As shown in FIG. 1, reservoir 1 contains a liquid 16 while reservoir 7 contains a powder 17.

The container of FIG. 1 operates in the following manner.

Figure 2:
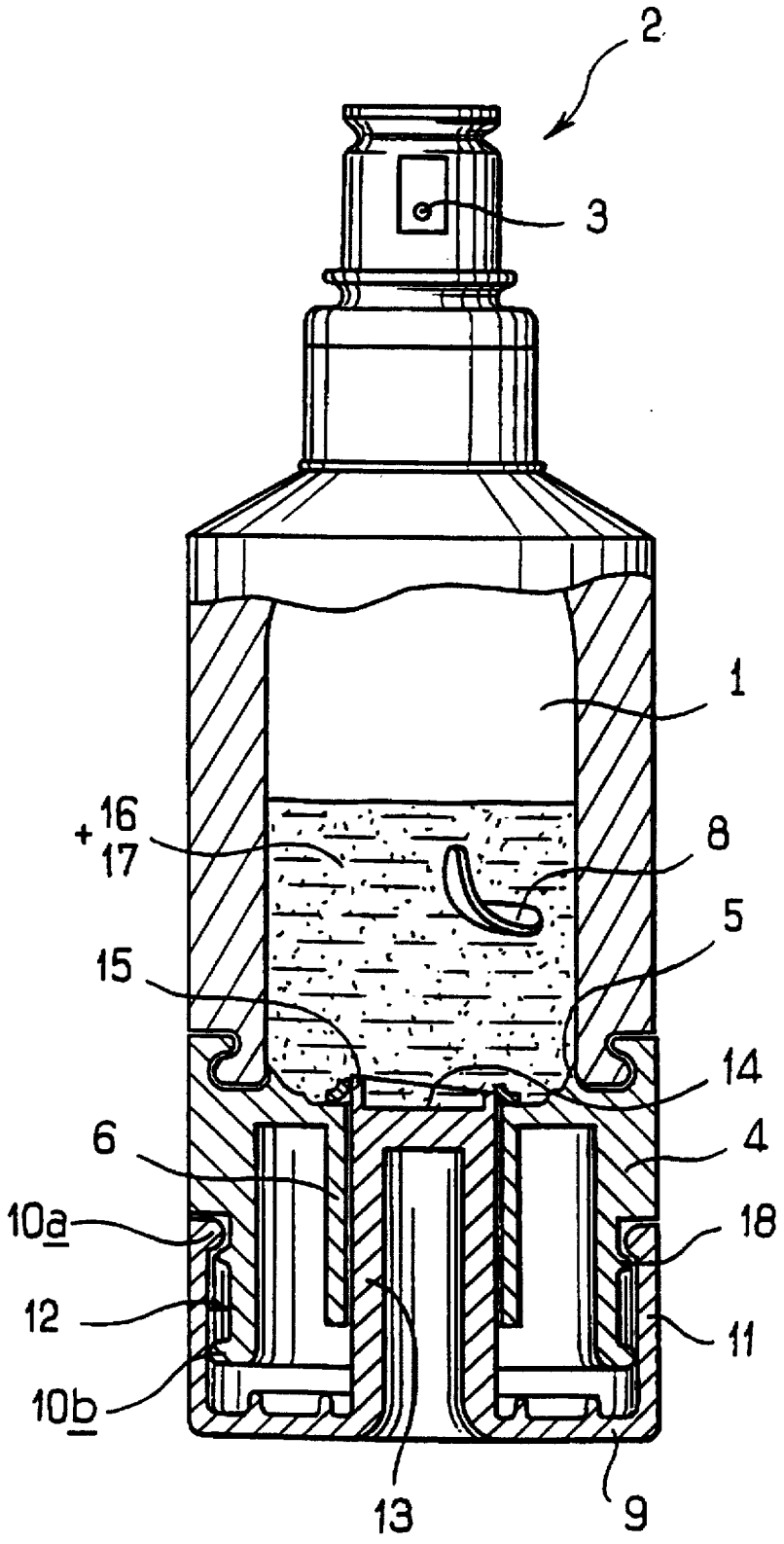
FIG. 2 is the same view of the device in FIG. 1 after the movable part of the container has been moved.

For storing products 16 and 17, the container is kept in the position shown in FIG. 1. To mix the two products, force is applied to pusher 9 to move it in the direction toward dispensing orifice 3 of the container. Piston 13 moves in shaft 6, and eventually, edge 15 cuts seal 8, as illustrated in FIG. 2. Products 16 and 17 are then free to mix in the first reservoir 1.

As shown in FIG. 2, wall 14 extends beyond the inside wall of reservoir 1 so that the volume of the second reservoir is reduced to zero. Therefore, there is no recess for powder 17 to agglutinate. As a result, good homogenization of the mixture is obtained. Seal 8, once cut, remains in reservoir 1 while the mixture is dispensed.

As shown in FIG. 2, base 4 has an annular boss 18 that holds pusher 9 in the compressed position once products 16 and 17 are mixed.

The container, while in the compressed position, is compact, which facilitates its use during dispensing. In one variant (not shown), the mechanism 2 and pump are replaced by a simple tip and the product is dispensed by merely pressing the side wall of reservoir 1, which may be made of an elastic material.

Figure 3:
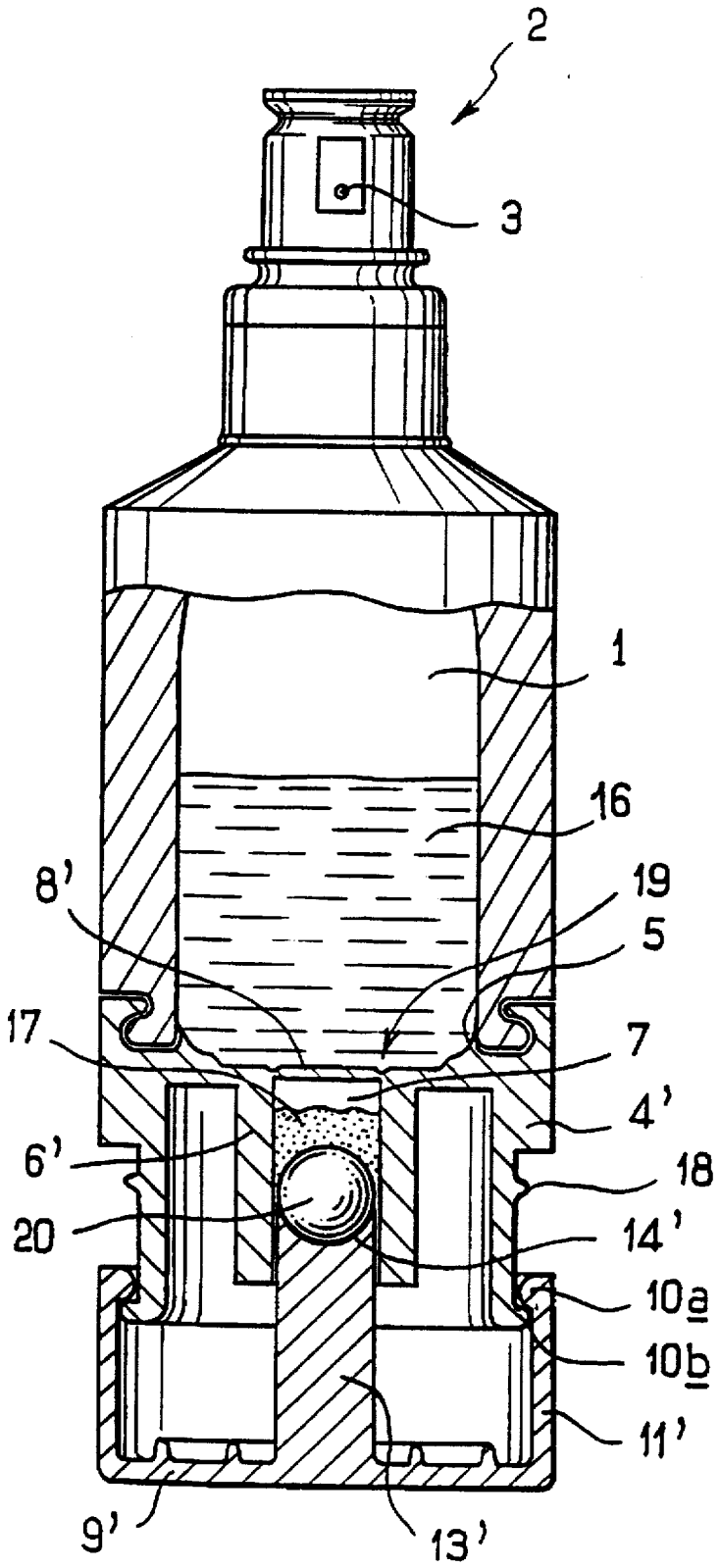
FIG. 3 is a view similar to FIG. 1 of a container according to a second embodiment of the invention.

In the embodiment shown in FIG. 3, the movable wall 8' separating reservoir 1 and reservoir 7 is made of a thin film molded in one piece with base 4'. At the periphery of wall 8', a score 19 is provided to facilitate disconnection of wall 8' from base 4'. Such a movable wall 8' could also be used in the container of FIGS. 1 and 2.

In the embodiment of FIG. 3, piston 13' of pusher 9' is distinguished from pusher 13 previously described in that it has a wall 14' arranged to receive a ball 20 of substantially the same diameter as the inner diameter of shaft 6' of base 4', which in this case has a circular inside cross section.

As shown in FIG. 3, powder 17 is accommodated in container 7 between movable wall 8' and ball 20. When pusher 9' is moved, piston 13' simultaneously ejects powder 17 and ball 20 into reservoir 1. This prevents any accumulation of powder in reservoir 7. Once pusher 9' is immobilized in the compressed position, wall 14' projects perceptibly beyond the inside wall of container 1.

Figure 4:
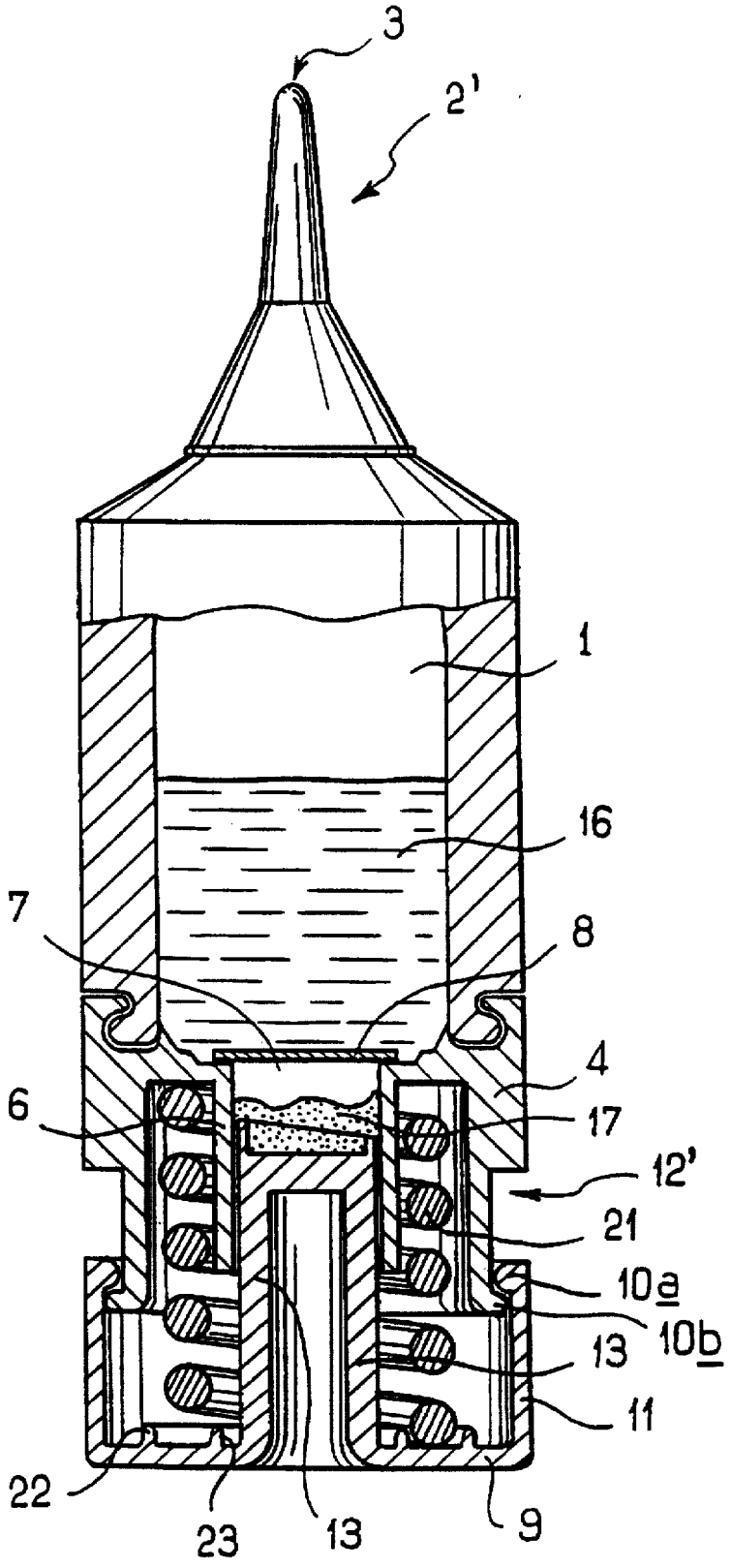
FIG. 4 is a view similar to FIG. 1 of a container according to a third embodiment of the invention.
Figure 5:
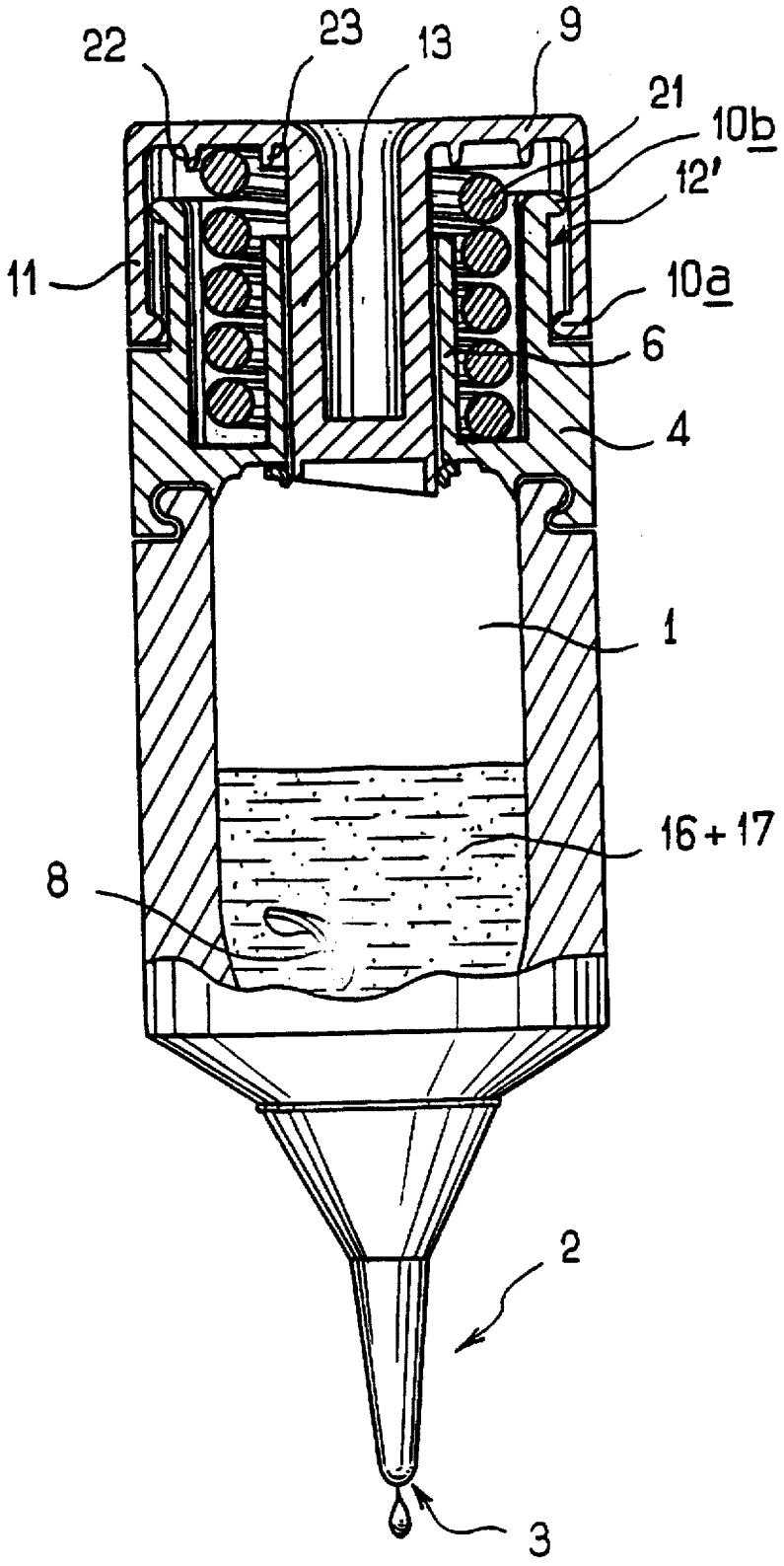
FIG. 5 is the same view of the container of FIG. 4 while a dose of product is being dispensed.

In the embodiment of FIGS. 4 and 5, the container has, in place of the pusher mechanism 2, a simple tip 2' of elongate shape, provided with a dispensing orifice 3 at its upper end. Dispensing orifice 3 can be blocked, for example, with a cap (not shown).

In this embodiment, base 4 and pusher 9 are identical to those described with reference to FIGS. 1 and 2. The container also has an elastic element comprised of, for example, a helical spring 21 accommodated around shaft 6 of base 4 and piston 13 of pusher 9. At its lower end, the spring 21 is immobilized between ribs 22, 23 formed on the inside surface of pusher 9.

Recess 12' of base 4 does not have a boss 18, in contrast with the embodiments described previously. Pusher 9 is thus continuously brought by helical spring 21 into the position shown in FIG. 4.

To mix the two products 16 and 17, as with the previous embodiments, pusher 9 is pushed in, which has the effect of cutting seal 8. Once the two products 16 and 17 are mixed, pusher 9 is released and is returned to its initial position.

Dispensing orifice 3 can then be opened, and pusher 9 can be used to dispense a dose of mixture. As shown in FIG. 5, piston 13, by moving in shaft 6 by a length of travel defined by the distance separating rib 10*b* and the upper end of recess 12', creates an overpressure in reservoir 1. The overpressure causes a predetermined dose of the mixture contained in reservoir 1 to emerge via orifice 3. Thus, pusher 9 serves both to mix the products and to dispense a predetermined dose of these products.

Figure 6:
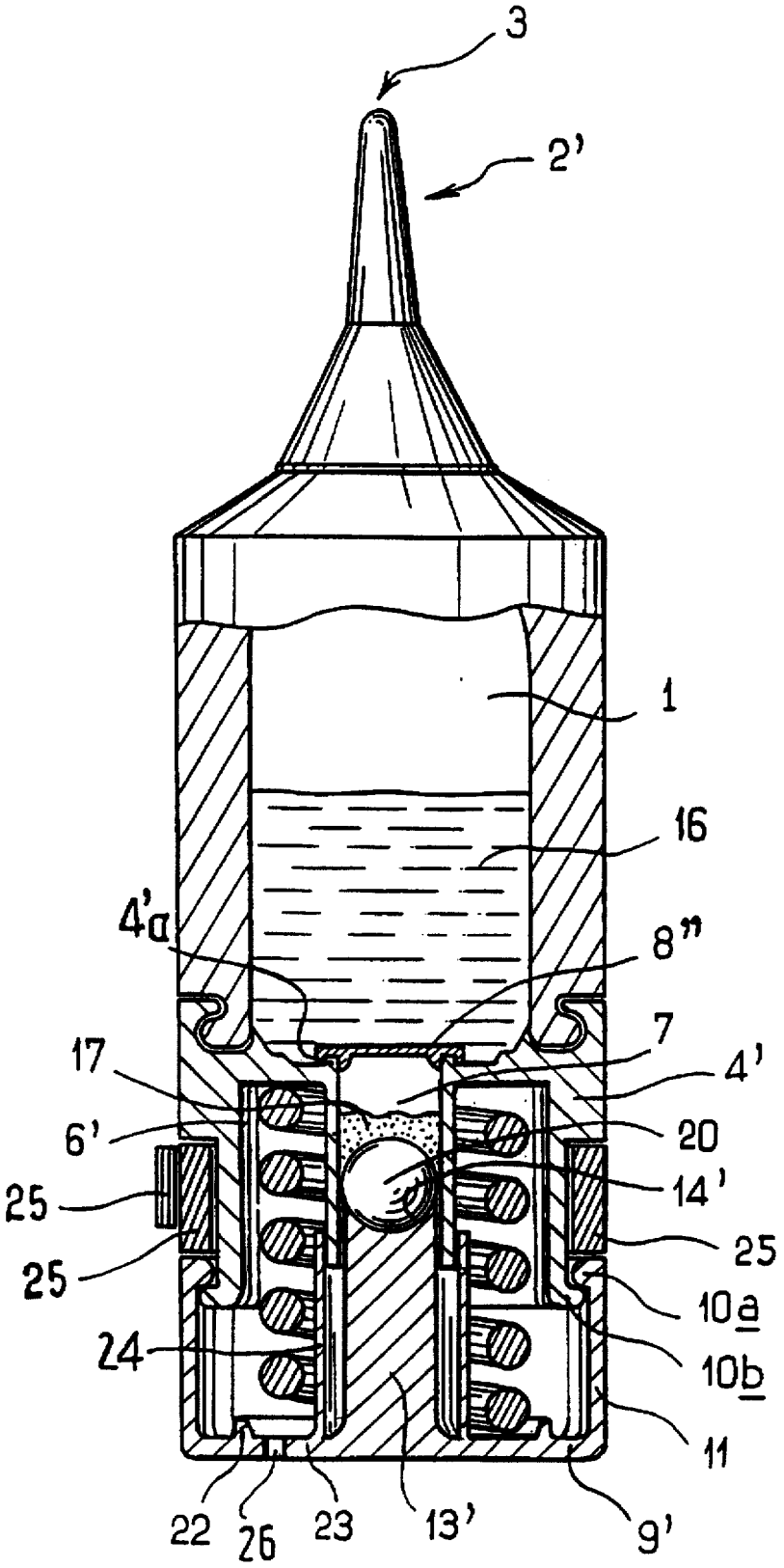
FIG. 6 is a view similar to FIG. 1 of a container according to a fourth embodiment of the invention.

In the embodiment shown in FIG. 6, some of the features of the embodiments described above are combined, with new features.

Reservoir 7 contains a ball 20 resting on a wall 14'. Pusher 9' serves both as an element for product mixing and dispensing.

The fluid-tightness of movable part 13', after elimination of movable wall 8", is improved by the presence of a second wall 24 surrounding piston 13'. The second wall 24 forms an annular space having inner and outer diameters substantially equal to the inner and outer diameters, respectively, of shaft 6 of base 4.

Movable wall 8" can be made of a material suitable for preservation of products 6 and 7.

Snap-fitting of wall 8" on edges 4'*a* of base 4 is a possible form of connecting movable wall 8" to base 4". In this case, wall 8" is removed without cutting. Rather, connecting portions formed on the wall 8" releasably and sealingly engage edges 4'*a*.

To prevent tampering and to provide an indication of whether the products 16 and 17 have been mixed, a tamperproofing ring 25 may be provided. As long as ring 25 remains intact, the products 16 and 17 have not been mixed.

A vent 26 allows the passage of air between the outside and the space formed by the base 4' and pusher 9'.

Figure 7:
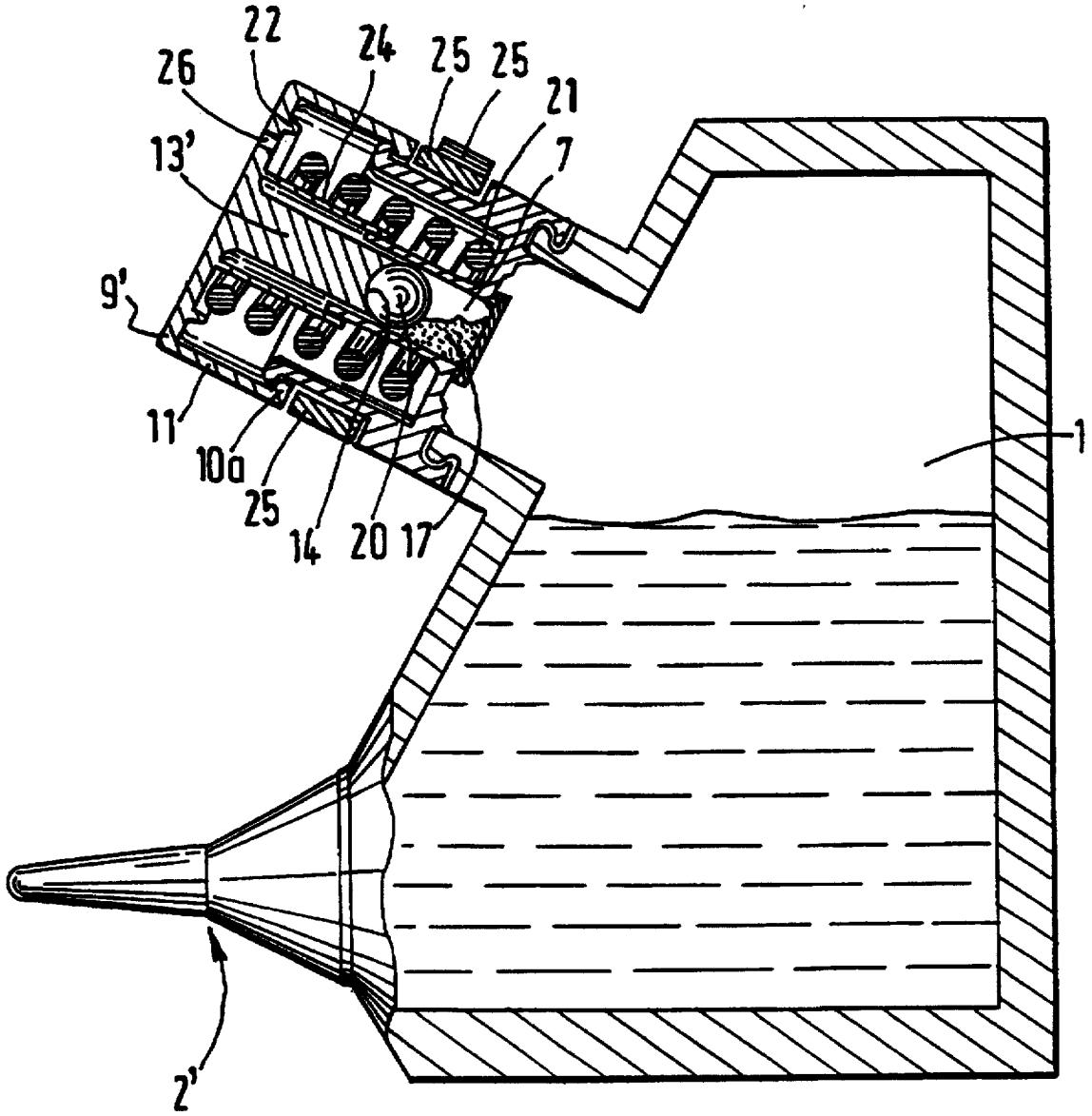
FIG. 7 is a view similar to FIG. 1 of a container according to a fifth embodiment of the invention.

FIG. 7 shows a container having the same elements as that of FIG. 6 except that reservoir 1 is not cylindrical and that base 4, piston 13, and second reservoir 7 are located on the front wall of the container.

Of course, the embodiments described above are not limiting in nature and can receive any desirable modifications without thereby departing from the framework of the invention.

For example, the second reservoir may store two or more products which are separated by movable superimposed partitions that can be torn or cut by the movable part as it moves to the second position. In addition, the dispensing orifice can be of any nature, for example, a porous applicator such as sponge foam, a brush, a dropper, etc.

What is claimed is:

1. A dispenser for storing at least two products, mixing the stored products and dispensing the mixture of the stored products, comprising:

a first product reservoir provided with a dispensing orifice;

a cylindrical second product reservoir having a mouth fixed relative to and contiguous to said first product reservoir;

a movable wall positioned in said mouth for separating the first and second reservoirs during separate storage of the products;

a movable bottom for said second reservoir, said bottom having an external cross section substantially equal to the internal cross section of the mouth; and actuating means for displacing said movable bottom towards said movable wall up to a position close to said mouth defining an end of the maximum stroke of the movable bottom, said displacement of said movable bottom causing said movable wall to be displaced and the contents of said second reservoir to be driven into said first product reservoir, wherein the mouth is fixed relative to and contiguous to said first product reservoir during the dispensing of the mixture of the stored products.

2. The dispenser according to claim 1, wherein said actuating means is a first reservoir overpressure device and the dispenser further comprises a return element, whereby a predetermined dose of the mixture can be dispensed by movement of the actuating means in a direction against the return element.

3. The dispenser according to claim 1, wherein said bottom has a planar surface surrounded by an edge having an upper end located in a plane inclined relative to a plane perpendicular to the direction of movement of said actuating means.

4. The dispenser according to claim 1, wherein said second reservoir has a circular inside cross section and said bottom is arranged to receive a ball.

5. The dispenser according to claim 1, further comprising means for immobilizing the actuating means in said position where said movable bottom is close to said mouth.

6. The dispenser according to claim 1, further comprising a base having in a central portion thereof a cylindrical shaft, wherein the shaft forms a side wall of said second reservoir.

7. The dispenser according to claim 6, wherein the base is joined to the dispenser by a snap-fit connector.

8. The dispenser according to claim 1, wherein the first reservoir holds a liquid and the second reservoir holds a powder.

9. A dispenser for storing at least two products, mixing the stored products, and dispensing the mixture of the stored products, comprising:

a first product reservoir provided with a dispensing orifice;

a second product reservoir having a bottom and a mouth;

a movable wall positioned at the mouth of the second reservoir; and a movable part movable between a first position located outside the first reservoir and a second position located in the first reservoir, said movable part being in selective engagement with the movable wall, said movable part including a transverse partition that forms the bottom of the second reservoir, said transverse partition being located, when the movable part is in the first position, at a distance from the mouth of the second reservoir that is substantially the same as or less than the distance between said first and second positions of said movable part, said dispenser further comprising a base having in a central portion thereof a cylindrical shaft, wherein the shaft forms a side wall of said second reservoir and wherein said dispenser further comprises a return element arranged around the shaft of the base.

10. The dispenser according to claim 9, wherein the return element consists of a helical spring.

11. A dispenser for storing a powder and a liquid mixing the stored products and dispensing the mixture of the stored products, comprising:

a first reservoir provided with a dispensing orifice and holding said liquid;

a second product reservoir having a mouth fixed relative to and contiguous to said first reservoir, said second product reservoir holding said powder;

a movable wall positioned in said mouth for separating said first and second reservoirs during separate storage of the products;

a movable bottom for said second reservoir; and actuating means for displacing said movable bottom towards said movable wall up to a position close to said mouth defining an end of a maximum stroke of the movable bottom, said displacement of said movable bottom causing said movable wall to be displaced and the contents of said second reservoir to be driven into said first reservoir, wherein the mouth is fixed relative to and contiguous to said first product reservoir during the dispensing of the mixture of the stored products.

12. A dispenser for storing at least two products, mixing the stored products and dispensing the mixture of the stored products, comprising:

a first product reservoir provided with a dispensing orifice;

a cylindrical second product reservoir having a mouth fixed relative to and contiguous to said first product reservoir;

a movable wall positioned in said mouth for separating the first and second reservoirs during separate storage of the products;

a movable bottom for said second reservoir, said bottom having an outside cross section similar to the cross section of said mouth;

actuating means for displacing said movable bottom towards said movable wall up to a position close to said mouth defining an end of the maximum stroke of the movable bottom, said displacement of said movable bottom causing said movable wall to be displaced and the contents of said second reservoir to be driven into said first product reservoir, wherein said actuating means is a first reservoir overpressure device; and a return element, wherein a predetermined dose of the mixture can be dispensed by movement of the actuating means in a direction against the return element.

13. A dispenser for storing at least two products mixing the stored products and dispensing the mixture of the stored products, comprising:

a first product reservoir provided with a dispensing orifice;

a cylindrical second product reservoir having a mouth fixed relative to and contiguous to said first product reservoir;

a movable wall positioned in said mouth for separating the first and second reservoirs during separate storage of the products;

a movable bottom for said second reservoir, said bottom having an outside cross section similar to the cross section of said mouth; and actuating means for displacing said movable bottom towards said movable wall up to a position close to said mouth defining an end of the maximum stroke of the movable bottom, said displacement of said movable bottom causing said movable wall to be displaced and the contents of said second reservoir to be driven into said first product reservoir, wherein said bottom has a planar surface surrounded by an edge having an upper end located in a plane inclined relative to a plane perpendicular to the direction of movement of said actuating means.

14. A dispenser for storing at least two products, mixing the stored products and dispensing the mixture of the stored products, comprising:

a first product reservoir provided with a dispensing orifice;

a cylindrical second product reservoir having a mouth fixed relative to and contiguous to said first product reservoir, wherein said second reservoir has a circular inside cross section;

a movable wall positioned in said mouth for separating the first and second reservoirs during separate storage of the products;

a movable bottom for said second reservoir, said bottom having an outside cross section of similar to the cross section of said mouth, wherein said bottom is arranged to receive a ball; and actuating means for displacing said movable bottom towards said movable wall up to a position close to said mouth defining an end of the maximum stroke of the movable bottom, said displacement of said movable bottom causing said movable wall to be displaced and the contents of said second reservoir to be driven into said first product reservoir.

15. A dispenser for storing at least two products, mixing the stored products, and dispensing the mixture of the stored products, comprising:

a first product reservoir provided with a dispensing orifice;

a second product reservoir having a bottom and a mouth;

a movable wall positioned at the mouth of the second reservoir; and a movable part movable between a first position located outside the first reservoir and a second position located in the first reservoir, said movable part being in selective engagement with the movable wall, said movable part including a transverse partition that forms the bottom of the second reservoir, said transverse partition being located, when the movable part is in the first position, at a distance from the mouth of the second reservoir that is substantially the same as or less than the distance between said first and second positions of said movable part, said dispenser further comprising a base having in a central portion thereof a cylindrical shaft, wherein the shaft forms a side wall of said second reservoir and wherein a wall surrounds the movable part so as to form an annular space having inner and outer diameters substantially the same as inner and outer diameters, respectively, of the shaft.

16. A dispenser for storing at least two products, mixing the stored products, and dispensing the mixture of the stored products, comprising:

a first product reservoir provided with a dispensing orifice;

a second product reservoir having a bottom and a mouth;

a movable wall positioned at the mouth of the second reservoir; and a movable part movable between a first position located outside the first reservoir and a second position located in the first reservoir, said movable part being in selective engagement with the movable walls, said movable part including a transverse partition that forms the bottom of the second reservoir, said transverse partition being located, when the movable part is in the first position, at a distance from the mouth of the second reservoir that is substantially the same as or less than the distance between said first and second positions of said movable part, said dispenser further comprising a base having in a central portion thereof a cylindrical shaft wherein the shaft forms a side wall of said second reservoir and wherein the base includes at least one rib, the movable part being joined to a pusher, said pusher having an inside annular swelling on a side wall thereof, said pusher being held onto said dispenser by engagement of said annular swelling with said at least one rib.

17. A dispenser for storing at least two products, mixing the stored products and dispensing the mixture of the stored products, comprising:

a first product reservoir provided with a dispensing orifice;

a cylindrical second product reservoir having a mouth fixed relative to and contiguous to said first product reservoir;

a movable wall positioned in said mouth for separating the first and second reservoirs during separate storage of the products;

a movable bottom for said second reservoir, said bottom having an outside cross section similar to the cross section of said mouth;

actuating means for displacing said movable bottom toward said movable wall up to a position close to said mouth defining an end of the maximum stroke of the movable bottom, said displacement of said movable bottom causing said movable wall to be displaced and the contents of said second reservoir to be driven into said first product reservoir; and means for immobilizing the actuating means in said position where said movable bottom is close to said mouth.

18. A dispenser for storing at least two products, mixing the stored products and dispensing the mixture of the stored products, comprising:

a first product reservoir provided with a dispensing orifice;

a cylindrical second product reservoir having a mouth fixed relative to and contiguous to said first product reservoir;

a movable wall positioned in said mouth for separating the first and second reservoirs during separate storage of the products;

a movable bottom for said second reservoir, said bottom having an outside cross section similar to the cross section of said mouth;

actuating means for displacing said movable bottom toward said movable wall up to a position close to said mouth defining an end of the maximum stroke of the movable bottom, said displacement of said movable bottom causing said movable wall to be displaced and the contents of said second reservoir to be driven into said first product reservoir; and a base having in a central portion thereof a cylindrical shaft, wherein the shaft forms a side wall of said second reservoir.

19. A dispenser according to claim 18, wherein the base is joined to the dispenser by a snap-fit connector.

* * * * *